US010772396B2

(12) United States Patent
Lauper et al.

(10) Patent No.: US 10,772,396 B2
(45) Date of Patent: Sep. 15, 2020

(54) DECORATIVE PIECE PRODUCED BY SETTING ON AMORPHOUS METAL

(71) Applicant: Omega S.A., Bienne (CH)

(72) Inventors: Stephane Lauper, Cortaillod (CH); Gregory Kissling, Macolin (CH); Yves Winkler, Schmitten (CH); Alban Dubach, Bienne (CH); Stewes Bourban, Chabrey (CH); Alexandre Netuschill, Le Locle (CH); Lionel Blaser, Corcelles (CH)

(73) Assignee: Omega S.A., Bienne (CH)

( * ) Notice: Subject to any disclaimer, the term of this patent is extended or adjusted under 35 U.S.C. 154(b) by 869 days.

(21) Appl. No.: 14/132,161

(22) Filed: Dec. 18, 2013

(65) Prior Publication Data

US 2014/0178625 A1 Jun. 26, 2014

(30) Foreign Application Priority Data

Dec. 21, 2012 (EP) ..... 12199276
Apr. 26, 2013 (EP) ..... 13165604

(51) Int. Cl.
*A44C 17/04* (2006.01)
*A44C 17/00* (2006.01)

(52) U.S. Cl.
CPC ..... *A44C 17/04* (2013.01); *A44C 17/005* (2013.01); *Y10T 29/23* (2015.01); *Y10T 428/22* (2015.01)

(58) Field of Classification Search
CPC ..... G04B 13/022; G04B 13/026; Y10T 29/49581; Y10T 428/22; A44C 17/04
See application file for complete search history.

(56) References Cited

U.S. PATENT DOCUMENTS 4,052,863 A * 10/1977 Poll ..... A44C 17/04 156/298
5,072,601 A * 12/1991 Slowinski ..... A44C 17/005 63/28
5,520,017 A * 5/1996 Vivat ..... A44C 17/005 63/28

(Continued)

FOREIGN PATENT DOCUMENTS

CH 383270 6/1964
CH 702 836 B1 9/2011

(Continued)

OTHER PUBLICATIONS

English translation of CH7021836 retreived from Espacenet Mar. 31, 2016.*

(Continued)

*Primary Examiner* — Frank J Vineis
*Assistant Examiner* — Laura B Figg
(74) *Attorney, Agent, or Firm* — Oblon, McClelland, Maier & Neustadt, L.L.P.

(57) ABSTRACT

The present invention relates to a decorative piece comprising a support produced in a material which does not include plastic deformation and in which at least one hollow is provided, characterised in that said hollow being filled with a first material being an at least partially amorphous alloy forming a substrate in which at least one housing is provided, said at least one housing being designed so that at least one aesthetic element can be housed therein.

33 Claims, 8 Drawing Sheets

(56) References Cited

U.S. PATENT DOCUMENTS

| | | | | |
|---|---|---|---|---|
| 5,848,539 | A * | 12/1998 | Ouzounian | A44C 17/04 63/28 |
| 6,491,424 | B1 * | 12/2002 | Tardy | G04B 39/00 368/283 |
| 2006/0037361 | A1 * | 2/2006 | Johnson | A44C 27/002 63/37 |
| 2011/0259753 | A1 * | 10/2011 | Grossenbacher | B44C 1/26 205/162 |
| 2014/0174125 | A1 * | 6/2014 | Lauper | A44C 27/00 63/28 |

FOREIGN PATENT DOCUMENTS

| | | | | |
|---|---|---|---|---|
| CH | 7021836 | B1 * | 9/2011 | |
| DE | 502 401 | | 7/1930 | |
| WO | 2004/047582 | A2 | 6/2004 | |
| WO | WO 2011064092 | A1 * | 6/2011 | A44C 17/005 |

OTHER PUBLICATIONS

European Search Report dated Jul. 23, 2013, in Patent Application No. EP 13 16 5604, filed Apr. 26, 2013 (with English-language translation).

* cited by examiner

DECORATIVE PIECE PRODUCED BY SETTING ON AMORPHOUS METAL

This application claims priority from European Patent Application No. 13165604.3 filed Apr. 26, 2013 and European Patent Application No. 12199276.2 filed Dec. 21, 2012, the entire disclosure of which is hereby incorporated by reference herein by reference.

The present invention relates to a decorative piece. This decorative piece comprises a support into which at least one aesthetic element is set.

TECHNOLOGICAL BACKGROUND

There are known, in prior art, decorative pieces which are intended to be set into a wearable object, such as a watch or jewellery, and which consist of setting of an aesthetic element on the parts of said wearable object acting as support.

For this purpose, the support is produced in a metallic alloy and is machined so that housings appear. During this machining, catching means having the shape of hooks are produced. In general, these hooks are produced with the material forming the wearable object, i.e. in a monobloc fashion with the object. When an aesthetic element, such as a precious stone, has to be set, the latter is placed in a housing and the catching means are folded down, cold, by plastic deformation in order to retain said aesthetic element in the housing. This setting method is widely used for setting precious stones on metal supports because the latter has an advantageous plastic deformation capacity. This capacity is even more advantageous with precious metals such as gold because these precious metals are ductile and can be shaped easily. The cold plastic deformation of crystalline metals is possible thanks to the movements of dislocations present in the crystal lattices. The elastic limit, i.e. the stress beyond which a material begins to deform plastically, of a crystalline alloy depends upon the elements which form the latter and also the thermomechanical history of the alloy. For traditional settings, alloys which have relatively low elastic limits are generally chosen in order to facilitate the work of the setter. In addition to a relatively low elastic limit, it is necessary that the alloy has sufficient elongation before rupture in order to be able to fold down the catching means without them breaking. As with the elastic limit, this elongation is the consequence at the same time of the elements present in the alloy and the thermomechanical history of the latter. For example, gold alloys used in the manufacture of timepieces have an elastic limit of the order of 200-400 MPa and a breaking elongation of 20-40%. Stainless steels of type 1.4435 have an elastic limit of 200-300 MPa and a breaking elongation of 25-45%.

Nevertheless, a disadvantage of this method is that it is limited to supports produced in ductile metals or ductile metallic alloys. Now, more and more timepieces are produced in materials which do not have plastic deformation, often hard and/or fragile materials, such as for example ceramics, silicon, composites or even intermetallic alloys.

Consequently, it is no longer possible to use the current method for setting aesthetic elements such as for example precious stones.

This setting operation is therefore replaced by a glueing operation. The disadvantage of glueing is not guaranteeing 100% retention of the stones because, in contrast to setting, this technique does not involve mechanical retention of the stones. In fact the glued zones being in the majority of cases exposed to the exterior environment (humidity, perspiration, UV, air pollution . . . ), the retention of the bonding over the long term is made difficult. Consequently, retention of the stones is not guaranteed, which is not acceptable for quality products.

SUMMARY OF THE INVENTION

The invention relates to a decorative piece which remedies the above-mentioned disadvantages of prior art by proposing a decorative piece and its production method which allow setting of the aesthetic element on a piece made of materials which do not have sufficient plastic deformation.

To this end, the invention relates to a decorative piece comprising a support produced in a material which does not include plastic deformation and in which at least one hollow is provided, characterised in that said hollow being filled with a first material being an at least partially amorphous alloy forming a substrate in which at least one housing is provided, said at least one housing being designed so that at least one aesthetic element can be housed therein, said substrate comprising in addition catching means which deform in order to retain said at least one aesthetic element in said at least one housing.

In a first advantageous embodiment, the catching means comprise at least one setting element.

In a second advantageous embodiment, said at least one hollow comprises vertical flanks in order to improve retention of each aesthetic element in the support.

In a third advantageous embodiment, said at least one hollow comprises flanks designed so that the surface of the hollow increases with the depth of the hollow.

In a fourth advantageous embodiment, said at least one hollow comprises flanks designed so that the surface of the hollow decreases with the depth of the hollow.

In another advantageous embodiment, said at least one hollow comprises retaining means which extend from one of the walls of the hollow in order to retain the first material in said hollow.

In another advantageous embodiment, the retaining means have the shape of at least one recess.

In another advantageous embodiment, the retaining means have the shape of at least one through-recess.

In another advantageous embodiment, the retaining means have the shape of at least one protuberance.

In another advantageous embodiment, the first material is a totally amorphous metallic material.

In another advantageous embodiment, the first material comprises at least one element which is of the precious type, included in the list comprising gold, platinum, palladium, rhenium, ruthenium, rhodium, silver, iridium or osmium.

In another advantageous embodiment, the distance between the aesthetic element and one edge of the hollow is at least 0.01 mm.

In another advantageous embodiment, the height of the housing is at least equal to the height of the culet of the aesthetic element.

The invention likewise relates to a method for setting at least one aesthetic element on a support comprising the steps of:

a) providing a support in a fragile material with at least one hollow;

b) providing at least one aesthetic element;

c) filling said hollow with a first, at least partially amorphous metallic material;

d) producing at least one housing and catching means in the first material;

e) setting said at least one aesthetic element by placing it in said at least one housing and by deforming the catching means so as to retain it.

In a first advantageous embodiment, setting step e) consists of a cold plastic deformation of the catching means.

In a second advantageous embodiment, setting step e) consists of a hot plastic deformation of the catching means.

In another third advantageous embodiment, setting step e) consists of an elastic deformation of the catching means.

In a fourth advantageous embodiment, setting step e) consists of thermal expansion of the support and of the first material in order to set said at least one aesthetic element in said at least one hole.

In a fifth advantageous embodiment steps c), d) and e) are simultaneous, the method consists of placing said at least one aesthetic element in the hollow then of filling said hollow with said first material.

In another advantageous embodiment, the setting method of at least one aesthetic element on a support comprises the steps of:

a) providing a support provided with at least one hollow;

b) providing at least one aesthetic element;

c) filling said hollow with a first, at least partially amorphous material;

d) heating said first material locally to at least its glass transition temperature;

e) inserting said at least one aesthetic element into the first material, then cooling.

In another advantageous embodiment, the setting method of at least one aesthetic element on a support comprises the steps of:

a) providing a support provided with at least one hollow;

b) providing at least one aesthetic element;

c) filling said hollow with a first, at least partially amorphous material;

d) heating said at least one aesthetic element locally to at least the glass transition temperature of said first material;

e) inserting said at least one aesthetic element into the first material, then cooling.

In another advantageous embodiment, the aesthetic elements are disposed edge to edge.

In another advantageous embodiment, the first material is a totally amorphous metallic material.

In another advantageous embodiment, the first material comprises at least one element which is of the precious type, included in the list comprising gold, platinum, palladium, rhenium, ruthenium, rhodium, silver, iridium or osmium.

In another advantageous embodiment, step c) of filling the hollow takes place by casting.

In another advantageous embodiment, step c) of filling the hollow takes place by hot forming.

In another advantageous embodiment, step c) of filling the hollow takes place by powder sintering.

In another advantageous embodiment, step c) consists of filling the hollow by driving in. This embodiment consists of heating the support in order to expand it thermally and increasing the dimensions of the hollow then placing the substrate in the hollow and finally contracting the support.

In another advantageous embodiment, the method comprises, in addition, a step consisting of crystallising the first material.

In another advantageous embodiment, the catching means comprise at least one setting element.

In another advantageous embodiment, said at least one aesthetic element comprises at least one throat into which said first material is inserted in order to improve the retention of said at least one aesthetic element.

Another advantage of this solution is that it makes it possible to set any type of material. In fact, the principle employed is a principle of set-in material, i.e. that a substrate in a deformable material is introduced into a plastically non-deformable material so as to allow setting and to give the illusion that it is this plastically non-deformable material which is set.

BRIEF DESCRIPTION OF THE FIGURES

The aims, advantages and features of the decorative piece and of the method thereof according to the present invention will appear more clearly in the following detailed description of at least one embodiment of the invention, given solely by way of non-limiting example and illustrated by the annexed drawings in which.

DETAILED DESCRIPTION

In the following description, all the parts of the decorative piece which are well known to the person skilled in the art in this technical field will be explained only in a simplified manner.

Figure 1:
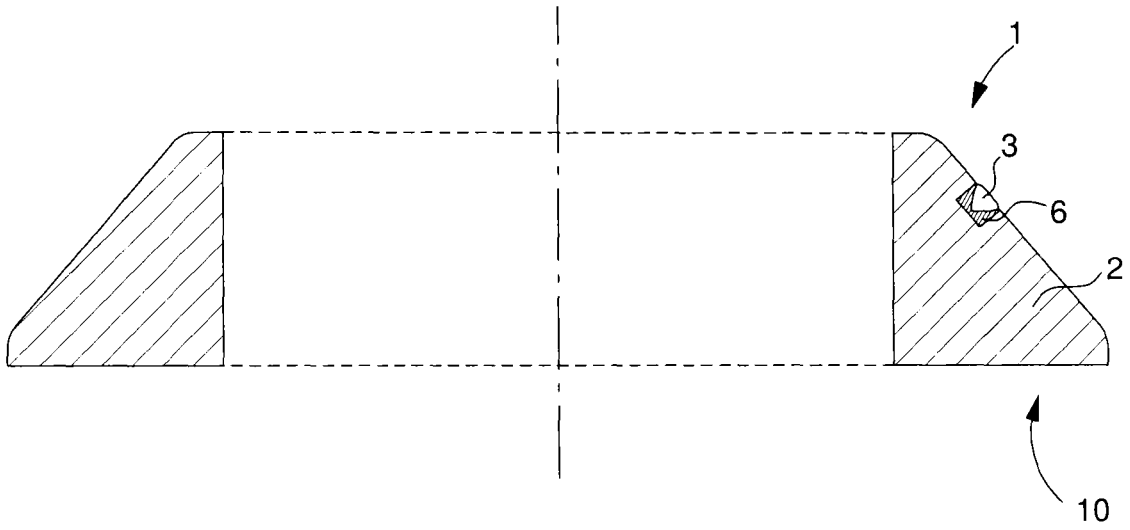
FIGS. 1 and 2 represent schematically an example of a decorative piece using the present invention.
Figure 2:
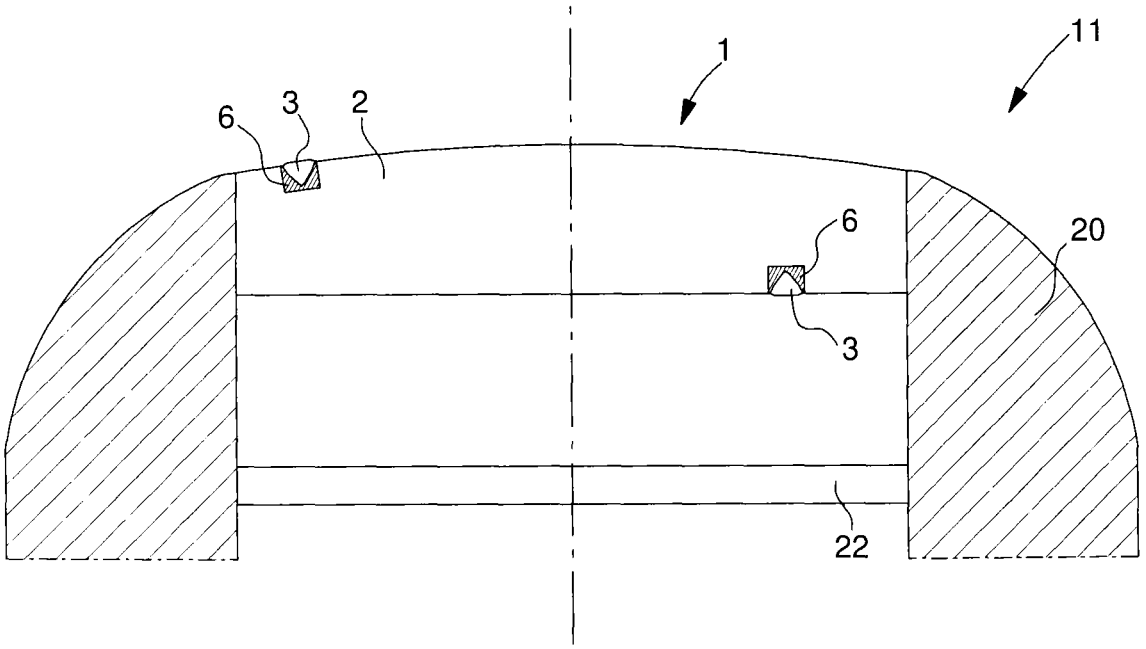

As can be seen in FIGS. 1 and 2, the present invention is a decorative piece 1. It is composed of a first part 2 and of a second part 3. The two parts 2, 3 are designed to be integral one with the other. More particularly, the second part 3 is intended to be set in the first part 2. For example, the first part can be a support 2 and the second 3, one or several aesthetic elements. This or these aesthetic elements 3 can be precious stones, such as diamonds or rubies or non-precious stones, such as zircons or any other possible aesthetic element.

In FIGS. 1 and 2, embodiments of the invention are represented. The decorative piece 1 can be, for example, a watch glass 10 which is inlaid with signs as can be seen in FIG. 1 or a watch glass 11 which can be seen in FIG. 2 or a dial 22 or any exterior parts of a watch or a timepiece. In the example of a dial, the latter comprises a discoid body forming the support 2 in which aesthetic elements 3 are set. This dial can be, for example, produced in ceramic material. It will be understood that ceramic is not the only material which is able to be used. Thus, any material which does not have sufficient plastic deformation can be used, such as sapphire, silicon or glass. In the case of a crystal made of sapphire, it is of interest to set said crystal to allow a visual effect in three dimensions, such as a watch dial or a logo above the hands. It will be understood that the decorative piece 1 can likewise be a pen or a cuff button or an item of jewellery, such as a ring or an earring. The surface of the support 2 which will be set can be planar or curved, i.e. concave or convex.

Figure 4:
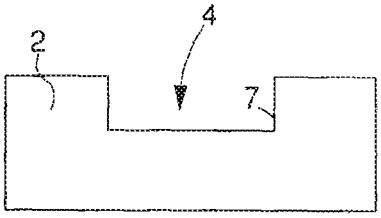

Advantageously according to the invention, this support 2 comprises at least one hollow 4, represented in FIG. 4, provided on said support in order to allow setting of at least one aesthetic element. Each hollow 4 therefore has the form of a unit and has flanks 7, preferably substantially perpendicular to the visible surface. These hollows 4 are used to allow use of a substrate 6 for the setting. In fact, the invention proposes to fill said hollow 4 with a more easily deformable first material so as to be able to set said at least one aesthetic element 3, which is not possible with a support 2 made of ceramic or silicon. Therefore in order to fill said hollows 4, it is intended, in the present invention, to use a first metallic material.

Figure 3:
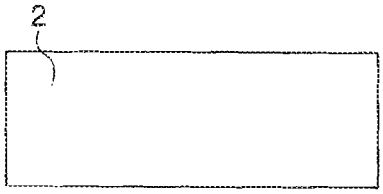
FIGS. 3 to 11 illustrate schematically the steps of the method for producing said first embodiment.

The first step, which can be seen in FIG. 3, consists of providing the support 2 in a material which does not deform plastically.

The second step which, can be seen in FIG. 4, consists therefore of producing at least one hollow 4 in the support 2. This hollow 4 can be produced for example by machining, by laser ablation, and even directly during casting of the support or by any other technique.

The third step consists of filling said hollow with a first material. This first material is then used to serve as substrate 6. The third step makes it possible to obtain the support 2 which can be seen in FIG. 6.

Advantageously according to the invention, the first material is an amorphous metallic alloy. It will be understood likewise that the metallic material will be partially amorphous or totally amorphous. The term partially amorphous indicates that, for a block of material, the percentage quantity of material of said block having the amorphous state is sufficient for the block itself to have the features which are specific to metals and amorphous metallic alloys. The amorphous materials have the advantage of being able to be shaped easily. Likewise, it may be possible to use a precious metal or one of these alloys in order to give a precious character to said decorative piece. Thus the precious metal or one of these alloys is included in the list comprising gold, platinum, palladium, rhenium, ruthenium, rhodium, silver, iridium or osmium.

Figure 5:
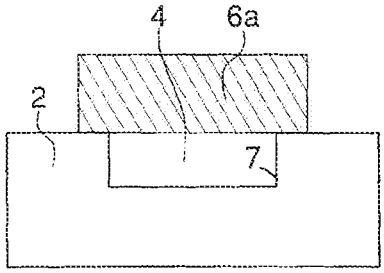
Figure 6:
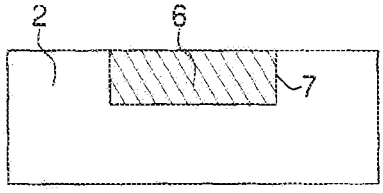

One of the methods for filling the hollow consists of using hot forming. FIGS. 5 and 6 represent, in a simplified manner, the steps of filling the hollow 4. Firstly, it is necessary, on the one hand, to produce the support 2 as can be seen in FIG. 3 and, on the other hand, to produce a preform 6*a* made of amorphous metallic alloy. This preform 6*a* can be produced by various techniques, such as for example by injection in a mould, hot forming above the Tg, stamping from a strip or even by machining. Once this preform 6*a* is produced, it is placed above the support 2, as can be seen in FIG. 5, on the face where said hollows 4 open in order to produce the filling of said hollows by hot forming. The assembly is then heated to a temperature greater than the glass transition temperature Tg, thus allowing a reduction in the viscosity of the preform, then a pressure is exerted. Once these conditions are combined, the pressure exerted on the viscous preform allows the viscous amorphous metallic alloy to fill the hollow 4 as can be seen in FIG. 6. Then, when the hollows 4 are filled as can be seen in FIG. 6, the assembly is cooled in order to preserve the amorphous state of the alloy.

Materials of this type are very suitable because they can thus easily fill all the volume of the hollow 4. After cooling, the vertical flanks 7 make it possible to retain the amorphous material by friction. Of course, the flanks 7 can be inclined so as to narrow the surface of the horizontal plane at the bottom of the hollow 4 or else, on the contrary, so as to enlarge it. It goes without saying that the most advantageous case is that where the surface of the bottom of the hollow 4 is largest since it makes it possible to retain naturally the amorphous metallic alloy in the hollow 4. Conversely, when the inclination causes a bigger section at the level of the surface of the support 2, retaining the amorphous material in the hollow 4 is no longer optimal. Another advantage is that this diminishing viscosity involves a reduction in the stress to be applied to fill the hollows 4 with the amorphous metallic alloy. For this reason, the support 2 made of fragile materials does not risk being broken even though a pressing operation is effected.

Of course other types of shaping are possible such as casting or injection moulding, powder sintering or by driving in.

The process of casting or injection moulding consists of heating a metallic preform above its melting point and then of casting or injecting the liquid metal, thus obtained, into the hollow 4 of the support 2.

The process of powder sintering consists of introducing a metallic powder into the hollow 4 of the support 2 and compacting it by applying energy, such as a furnace, a laser beam, an ion beam or any other thermal means. Once the hollow 4 is filled, a cooling step to a temperature lower than the Tg is effected so as to avoid crystallisation of the alloy in order to obtain a hollow 4 filled with amorphous or semi-amorphous metallic alloy.

The process of driving in consists of producing a block of amorphous metallic alloy, the dimensions and the shape of which are slightly greater than those of the hollow 4 and of forcing this block to fit into said hollow 4. Advantageously, it can be provided to produce this assembly step using thermal expansion. In order to do this, the support 2 is heated so that, under the effect of the heat, it expands thermally. The support 2 has its dimensions increased. This increase in the dimensions is likewise applicable to the hollow 4. Consequently, the difference between the dimensions of the hollow 4 and the dimensions of the block is modified so that the dimensions of the hollow 4 become greater than those of the block. It is then easy to insert the block into the hollow 4. When the support 2 is cooled it assumes its initial dimensions again and the block is situated wedged in said hollow 4.

Once the hollow is filled, a fourth preparation step is effected. This step consists of producing the setting housings (holes) 8 in which the aesthetic elements 3 are placed, and of producing the catching means. This step can be produced either in a standard manner, such as machining, milling, piercing, or in a less standard manner, by hot deformation, or by a combination of the two processes. The hot deformation method consists of using a tool which has the negative geometry of the hole and of the setting element and of applying this tool with a definite force and at a temperature greater than the glass transition temperature Tg of the amorphous metal, on the amorphous metallic alloy filling the hollow 4. It is hence possible to avoid the machining steps which can be difficult according to the amorphous metallic alloys which are used.

Figure 8:
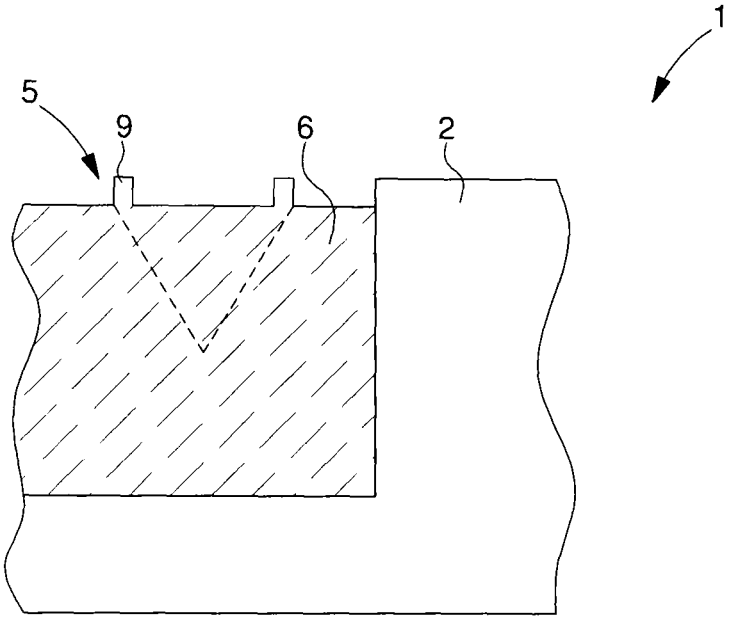
Figure 9:
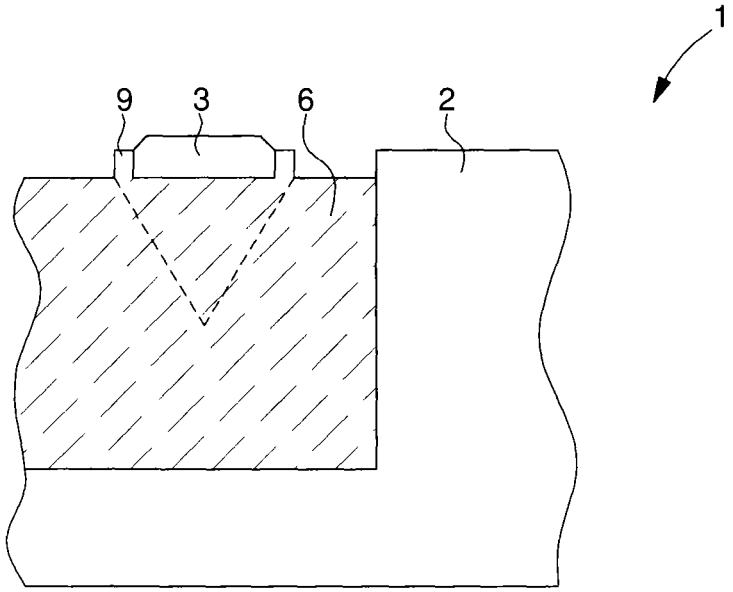
Figure 10:
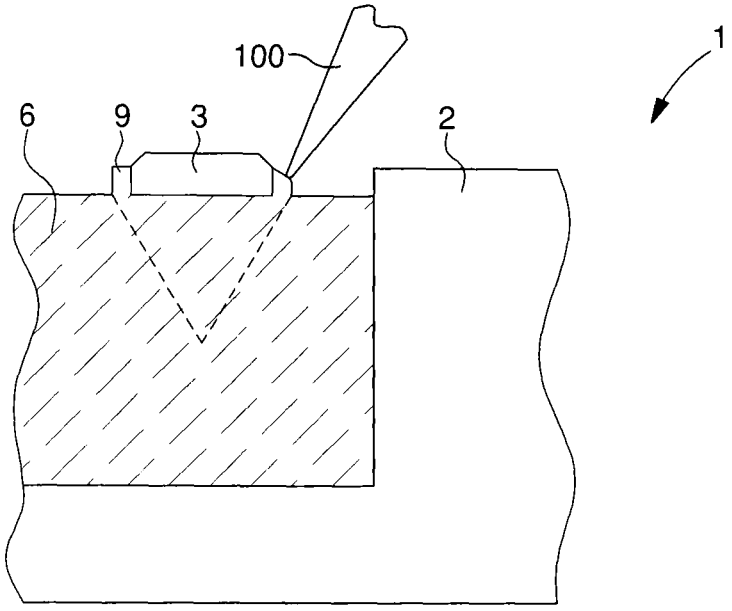
Figure 11:
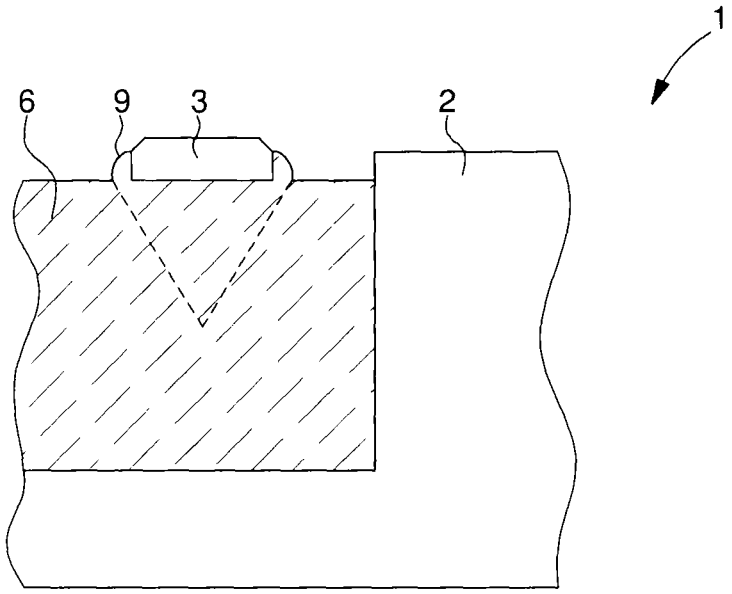
Figure 12:
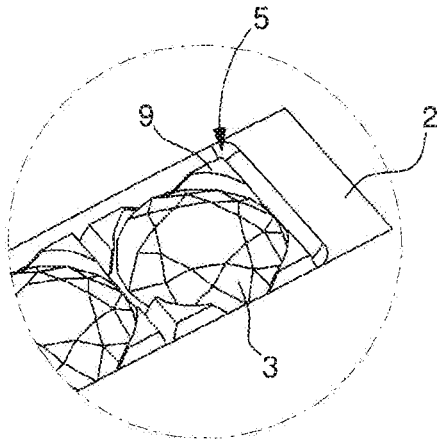
FIGS. 12 and 13 represent, in a view from above, aesthetic elements which are set and non-set according to the invention.
Figure 13:
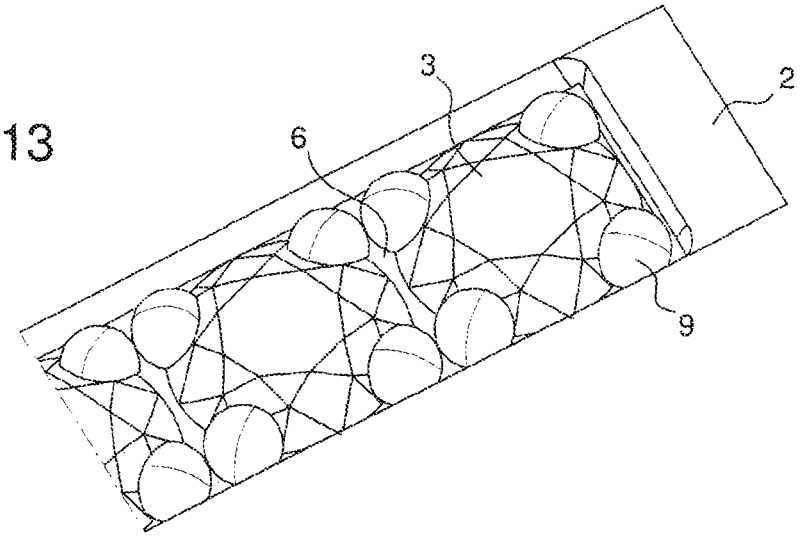

The catching means 5 have the shape of at least one setting element 9. This setting element 9, in the case for example of a bead setting, consists of prongs or beads provided on the circumference of each setting hole 8. These prongs 9, which can be seen in FIGS. 8 and 10, are produced by machining and are produced before or after piercing of the setting holes 8. In fact, during machining of the holes, some material of the substrate 6, i.e. of the first material, is raised so as to form these setting beads 9. Preferably in the case of a bead setting, it is provided to have ideally four setting beads 9 in the proximity of each setting hole 8, as can be seen in FIG. 10.

It will be understood that other types of setting can be imagined. Therefore, the closed setting, the baguette setting, the rail setting or an invisible setting are conceivable. For example the closed setting consists of a single setting element 9 which extends over the periphery of the aesthetic element 3. The baguette setting is used for setting aesthetic elements 3 cut as a baguette. This setting consists of providing setting elements 9 which extend parallel to each side of the aesthetic element 3 and come to be folded down on the latter. For the invisible setting, it is provided that the setting elements 9 are projecting portions provided in the setting hole 8. These projecting portions cooperate with at least one throat produced on said aesthetic element 3 so that the setting is produced by inserting the aesthetic element 3 into the hole 8 until the projecting portions are inserted in said at least one throat.

Figure 15:
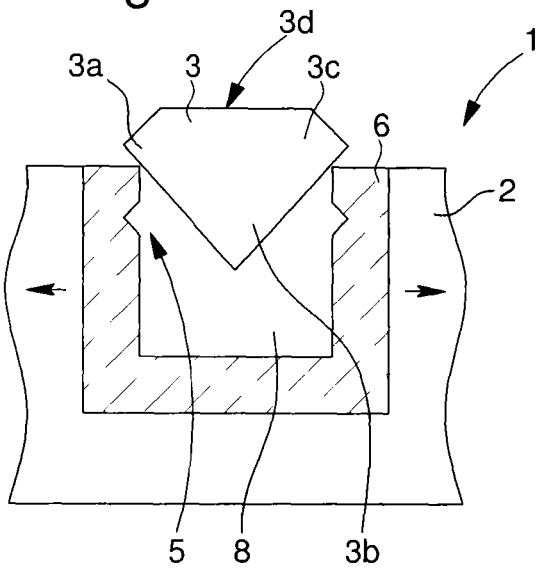
FIGS. 15 and 16 represent a third alternative of the method according to the invention.

In a particular embodiment which can be seen in FIG. 10, the aesthetic element 3 has the shape of a diamond comprising a culet 3*b* in which a plurality of facets and a crown 3*c*, likewise faceted and surmounted by a table 3*d*, are cut, as can be seen in FIG. 15. Seen from above, this aesthetic element has a substantially circular shape. In order that the illusion of a setting in the material of the support 2 is preserved, it is provided that the width of the hollow 4 is ideally equal to that of the aesthetic element 3. For preference, it will be understood that the distance between the aesthetic element 3 and the edge of the hollow 4 must be at least 0.01 mm so that the visual effect of the aesthetic element 3 in the support 2 is optimal, i.e. giving the impression that the aesthetic element 3 remains embedded in the support 2 made of ceramic and not in a metal. For the maximum distance between the aesthetic element 3 and the edge of the hollow 4, this will depend upon the dimensions and shapes of the aesthetic elements 3. By way of example, for an aesthetic element 3 of a diameter of 1 mm, the distance between the aesthetic element 3 and the edge of the hollow 4 will be 0.45 mm.

In another example, it is defined that the distance between the aesthetic element 3 and the edge of the hollow 4 is composed of a zone termed machined, i.e. a zone in which the setting beads are produced, this zone being able to be hollow, and of a zone termed non-machined which is an aesthetic visual zone. In this case, this non-machined zone will be at least 0.01 mm and at most 0.20 mm, preferably it will be 0.10 mm.

Equally, it will be understood that the height of the hole 8 is at least equal to the height of the culet of the aesthetic element 3. This makes it possible, when the aesthetic element 3 is set, to see the first material forming the substrate 6 as little as possible. In this case, the setting beads 9, four in number, are produced so as to have the shape of a right-angled triangle, the hypotenuse of which is convex. Preferably, the convex shape of the hypotenuse is similar to the curve of that of the aesthetic element 3 when the latter is seen from above.

Figure 7:
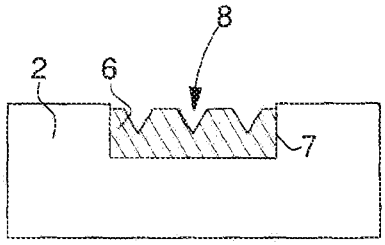

Once the fourth preparation step is finished, the support 2, which can be seen in FIG. 7, is obtained, the fifth setting step can then take place.

The standard setting step consists of a deformation. This technique consists of placing the aesthetic element 3 in the hole 8 and deforming the substrate and/or the setting elements 9 in order to place them on said aesthetic element 3, as can be seen in FIGS. 9 to 13. For this reason, the latter is retained in the setting hole 8. The deformation can be plastic. In this case, it takes place with a tool termed beading tool 100, used to deform each setting element 9, it makes it possible to obtain the set aesthetic element 3 of FIG. 13.

The deformation can likewise be elastic or obtained by thermal expansion. In the case of elastic deformation, the setting is obtained by clipping the aesthetic element in the catching means 5. It is obvious that, in this case, a slight plastic deformation of the catching means 5 could take place. In the case of deformation by thermal expansion, the setting is obtained by heating the support 2 to a sufficiently high temperature to allow inlaying of the aesthetic element 3 in its hole 8 without force. Cooling will then make it possible to contract the material allowing thus the aesthetic element 3 to be retained by the catching means 5.

It should be noted that amorphous metals, in contrast to crystalline metals, do not have dislocations and therefore cannot be deformed plastically by the movement of the latter. They therefore generally have a fragile behaviour, i.e. they break suddenly once the elastic limit is exceeded.

It has however been confirmed that certain amorphous alloys can accommodate a permanent macroscopic deformation by generation of bands of slippage on a microscopic scale. The exact nature of the latter is not at present clearly identified. Apart from depending upon the type of amorphous alloy, the capacity to accommodate a permanent deformation in the amorphous metals depends greatly upon the dimensions of the piece. Thus the more the dimensions of the stressed zone are small, the more the permanent deformation will be able to be large. For example, it is possible to fold, permanently, a strip of thickness 100 μm made of amorphous alloy Pt57.5Cu14.7Ni5.3P22.5 up to an angle greater than 90° without breaking, whilst a strip of the same dimension made of amorphous alloy Fe56Co7Ni7Zr8Ta8B20 will not accommodate any permanent deformation.

With respect to the preceding and in order to be able to use various amorphous alloys independently of their permanent deformation capacity, various embodiments have been conceived.

A first embodiment is used in the case where the amorphous alloys accommodate permanent deformation and have elastic limits which are not too high, typically less than 1,500 MPa: the setting method is identical to that used for crystalline metals, i.e. cold plastic deformation of the beads 9 produced in the amorphous alloy.

A second embodiment is used in the case where the amorphous alloys have elastic limits which are too high for cold plastic deformation, typically greater than 1,500 MPa: the setting method consists of heating the beads 9 to a temperature greater than the glass transition temperature Tg of the amorphous metallic alloy in order to reduce greatly the viscosity and therefore the force necessary for deformation thereof. Once the beads 9 are at the right temperature, they are deformed so that the setting can take place. A cooling operation is then effected in order to solidify them and to make it possible to make the setting definitive. This solution has the advantage of allowing an intimate contact between the amorphous metallic alloy and the aesthetic element 3, which improves retention of the latter. In fact, in the case of cold plastic deformation, as much for crystalline metals as amorphous ones, elastic resilience operates during release of the force applied on the bead 9. This resilience inevitably involves a slight separation between the bead 9 and the aesthetic element 3 which can cause retention problems. Now, the hot deformation used does not involve elastic resilience and there is therefore no release. This hot deformation can be produced after a cold deformation step or the converse.

Figure 16:
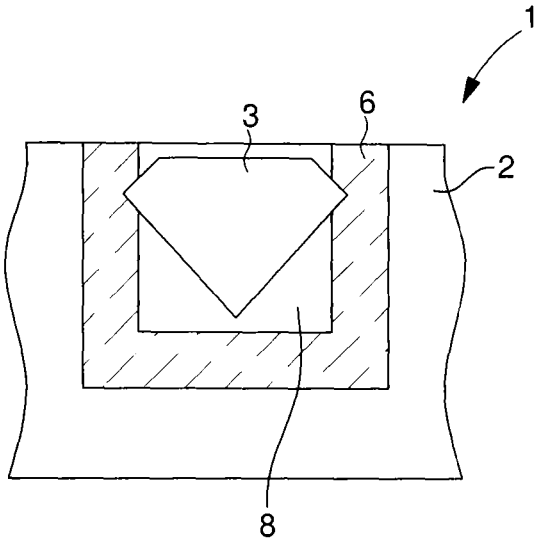

A third embodiment is used when the amorphous alloys are difficult to set by cold or hot plastic deformation. This embodiment consists of making use of the high elastic deformation of amorphous alloys, typically 2%, in contrast to crystalline alloys which deform plastically from 0.5%. The method consists of pressing the aesthetic element 3 into the setting hole of the substrate 6. Under pressure, the amorphous metallic alloy of the substrate 6 deforms elastically making it possible for the aesthetic element 3 to be inserted. When the catching means 5, in the shape of a setting recess, and the girdle or end or the edge 3*a* of the aesthetic elements 3 are situated one opposite the other, an elastic resilience operates. The elastic resilience of the catching means 5 on the aesthetic element 3 makes it possible to retain the latter definitively, as can be seen in FIGS. 15 and 16.

Figure 17:
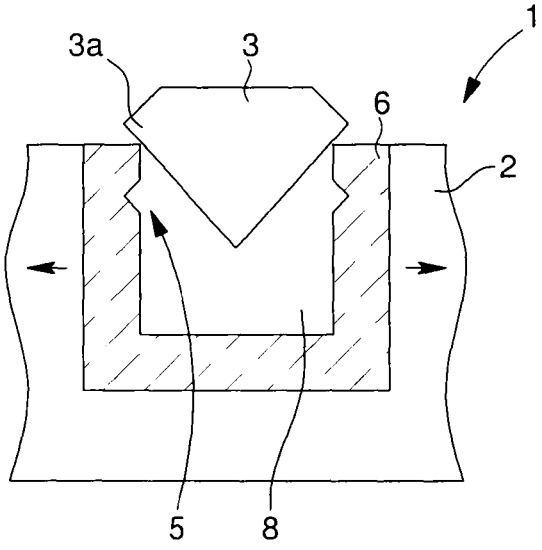
FIGS. 17 and 18 represent a fourth alternative of the method according to the invention.
Figure 18:
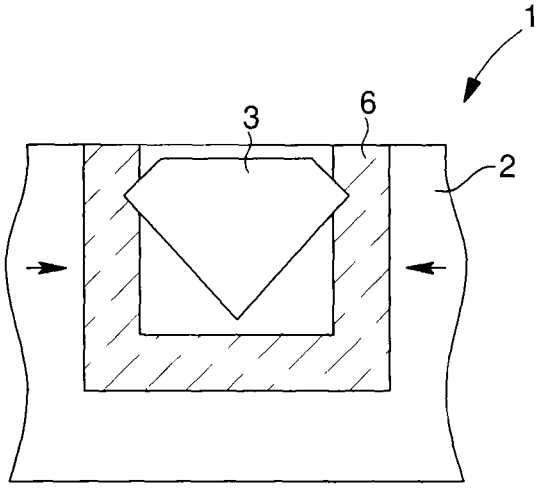
Figure 19:
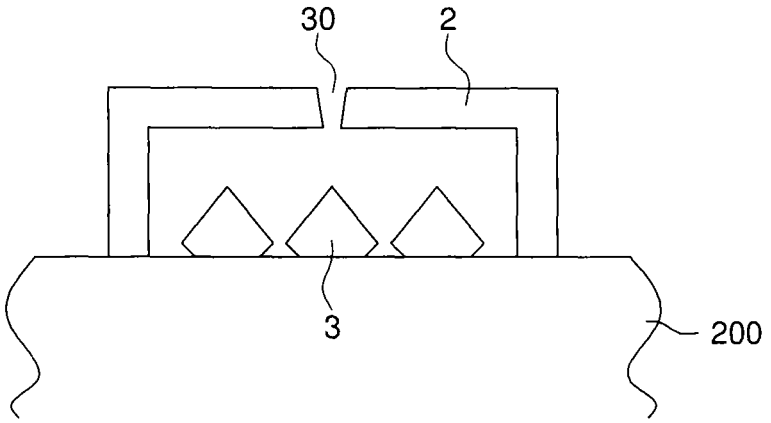
FIGS. 19 to 23 represent a fifth alternative of the method according to the invention.
Figure 20:
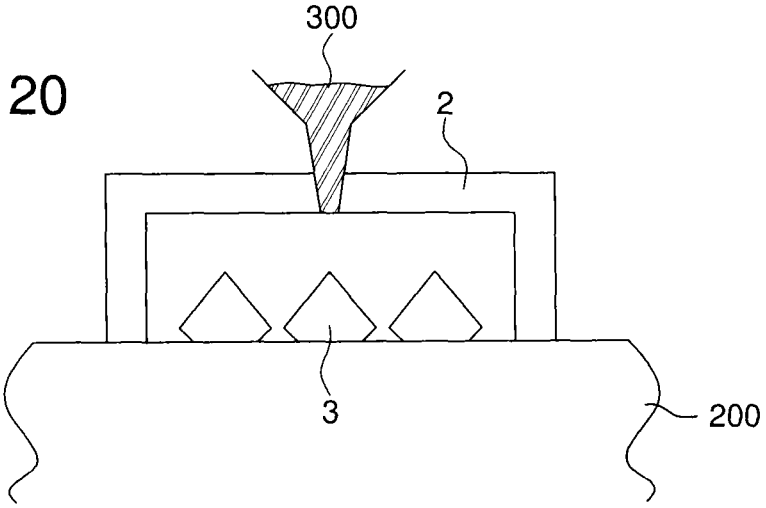
Figure 21:
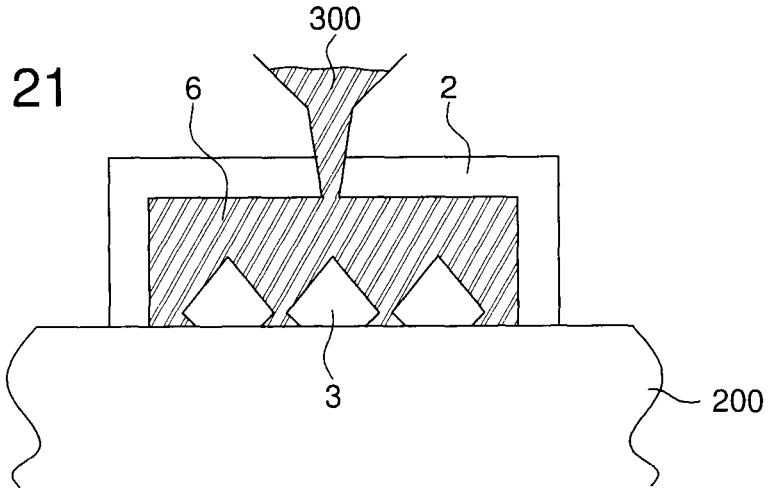
Figure 22:
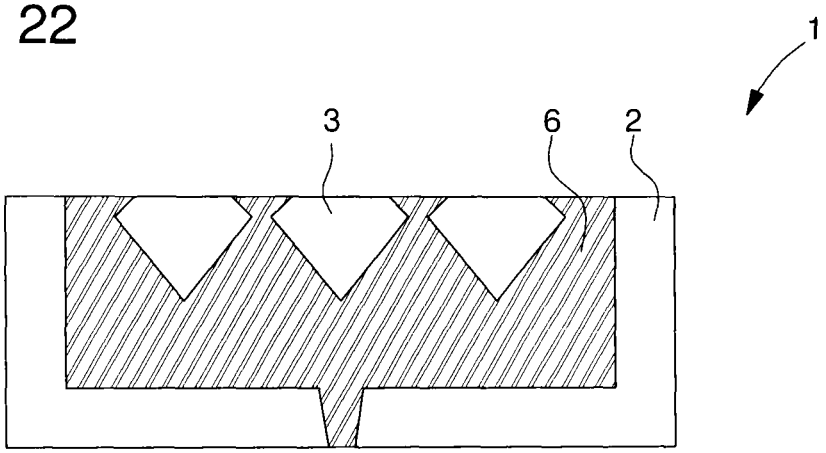

A fourth embodiment is likewise envisaged. In this embodiment, the support 2 is heated thermally such that all of the support expands, i.e. the support 2 and the substrate 6 made of amorphous alloy. Consequently, the setting hole 8 likewise expands. Consequently, the aesthetic element 3 can be placed in the setting hole 8. The aesthetic element 3 is then retained in the hole 8 by the catching means 5 after cooling of the support 2, as can be seen in FIGS. 17 and 18. These catching means 5 have the shape of a setting recess in which the girdle or the end or the edge 3*a* of the aesthetic element 3 is inserted.

A fifth embodiment can be envisaged in which the fourth step d) and the fifth step e) are simultaneous. This embodiment consists of heating the aesthetic element to a temperature greater than the glass transition temperature Tg of the first material then pressing it into the latter, i.e. the amorphous metallic alloy. The heat released by said aesthetic element heats the substrate 6 locally up to a temperature greater than the Tg which makes it possible for the amorphous metallic alloy to have its viscosity lowered greatly which thus facilitates the insertion. Then, once the aesthetic element is inserted, the substrate 6 is cooled in order to keep the amorphous state of the alloy and is trimmed of any surplus material. This step therefore allows better catching of the aesthetic element 3 in the substrate 6 thanks to the capacity of the amorphous metallic alloy to mould well to the contours.

A sixth embodiment in which the third c), fourth d) and fifth step e) are simultaneous is envisaged. This variant consists of providing that the aesthetic element 3 is placed directly in the hollow 4 before the step of filling said hollow 4 by the first material. The filling of the hollow 4 therefore takes place by casting, by hot forming or by sintering, the details of which have been explained previously. This technique makes it possible to have a more rapid setting process whilst guaranteeing good retention of the aesthetic elements 3.

A seventh embodiment, characteristic of an invisible setting, and able to be seen in FIGS. 19 to 23, can be effected. In the latter, the support 2 is provided, in the bottom thereof, with a hole 30 which serves for the filling. In fact, the process consists of being provided with a base 200 on which the aesthetic element or elements are placed. The latter are placed upside down. For example, for an aesthetic element such as a precious stone which is cut so as to comprise a culet in which several facets are cut and a crown which is likewise faceted and surmounted by a table, the table is in contact with the base and the culet points towards the top. Then, the support 2 is placed so that the hollow 4 is facing the base and so that the aesthetic element or elements 3 are situated in the space formed by the hollow 4. For preference, the aesthetic elements 3 are situated, relative to each other, according to their definitive arrangement. Of course, other arrangements of stones can be envisaged, such as for example stones, all the culets of the stones of which point towards the bottom, or stones disposed in a random manner, such that certain stones have the culets towards the top, others have the culets towards the bottom. Then, the first material, i.e. the amorphous metallic alloy which is stored in an apparatus 300, is poured or infiltrated into the hollow by means of the hole 3 which serves for the filling. The first material is thus preferably cast, injected or pressed thermally into said hollow 4 then solidified in order to set the position of the aesthetic elements 3. Advantageously, the hole 30 which serves for the filling is likewise filled such that, according to its profile, it can serve to retain the first material in the hollow 4. Finally, the base 200 and the support 2 are separated in order to obtain the decorative piece 1 according to the invention. Of course, it will be understood that the aesthetic elements 3 can be placed edge to edge in order to avoid the amorphous metallic alloy being visible. In the case of aesthetic elements 3 cut in order to comprise a culet 3*b* in which several facets are cut and a crown 3*c* which is likewise facetted and surmounted by a table 3*d*, the fact of placing the aesthetic elements 3 edge to edge makes it possible that the amorphous metallic alloy does not infiltrate between the crowns.

Figure 23:
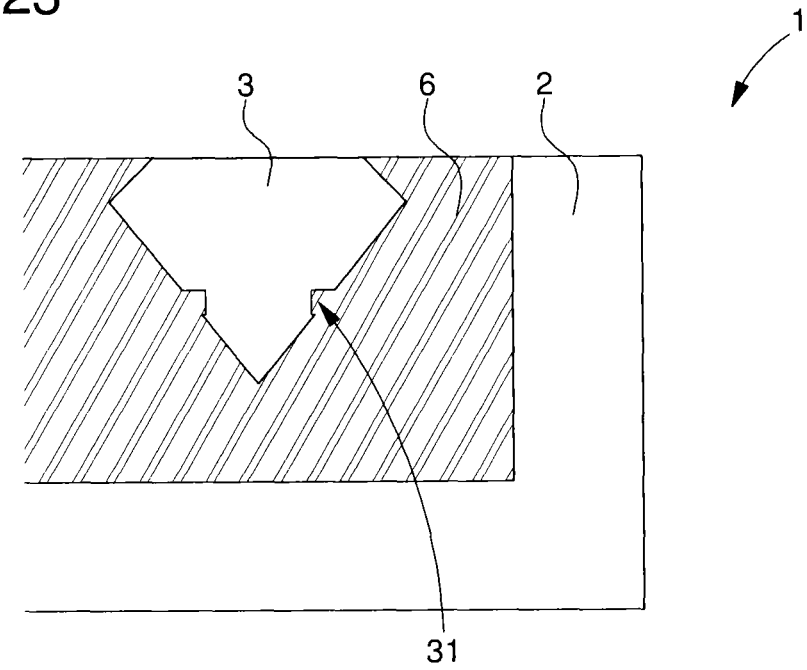

In a variant of the fifth to seventh embodiments, the aesthetic element 3 comprises at least one throat 31. This throat 31 makes it possible, during setting of the aesthetic element, for the amorphous metallic alloy to be inserted in said throat 31. In fact, as the amorphous metallic alloy moulds perfectly to the contours of a piece when it is heated to a temperature greater than the Tg or when it is liquid, the throat 31 therefore acts as a means allowing the aesthetic element to be anchored in the substrate 6 made of amorphous metal, as can be seen in FIG. 23.

One advantage of the invention is that it makes it possible to set any type of material. In fact, the principle used is a principle of a set-in piece, i.e. that a substrate in a material which can accept a deformation is set in a material which is not plastically deformable so as to allow setting and to give the illusion that it is this plastically non-deformable material which is inset.

Figure 14:
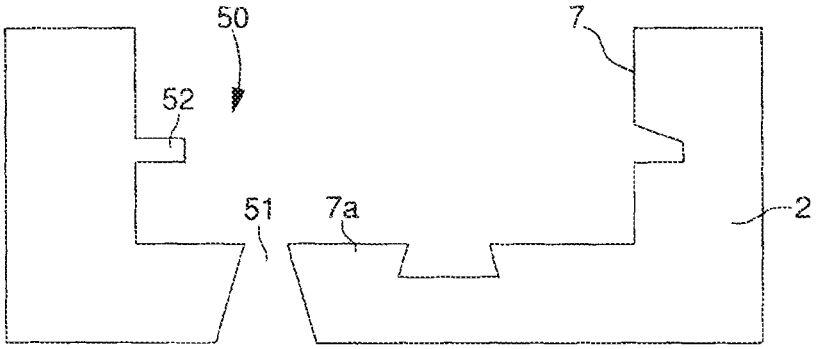
FIG. 14 represents a sectional view of the retaining means according to the invention.

In a first variant which can be seen in FIG. 14, retention of the first material is improved by using retaining means 50. These retaining means 50 comprise at least one recess 51 and/or at least one protuberance 52. These retaining means 50 are produced prior to the filling of the hollow 4. For this reason, during filling of said hollow, the first material which fills the recesses 51 or the protuberances 52 becomes encased by said first material. Consequently, when the first material has filled the hollow 4 and has solidified, it is retained perfectly in said hollow 4.

In the case where the first material is an amorphous metallic alloy, the low viscosity of the amorphous material makes it possible to fill the hollow 4 easily. Analogously, this low viscosity of the amorphous material likewise makes it possible to fill the recesses 51 better or to envelope the protuberances 52 better.

These recesses 51 or protuberances 52 can be situated on the vertical flanks 7 of the hollow 4 or at the level of the base 7*a* of the hollow 4. Likewise the recesses 51 can be through-recesses or not.

It will be understood that various modifications and/or improvements and/or combinations evident to the person skilled in the art can be applied to the various embodiments of the invention explained above without departing from the scope of the invention which is defined by the annexed claims.

Thus, it is conceivable that once the amorphous metal is shaped in the hollow 4 a crystallisation step takes place just before or just after the step of producing the setting holes 8. This step consists of heating the amorphous metal above its glass transition temperature Tg which lasts for a sufficiently long time for the crystallisation to be able to take place. Once crystallised, the alloy can be cooled. The crystallisation parameters (time and temperature) must be chosen so as to ensure the growth of crystalline, ductile and non-fragile phase(s). This makes it possible to take advantage of the properties for shaping the amorphous metal and to take advantage of the readiness of crystalline metals to deform plastically, in particular when cold.

What is claimed is:

1. A decorative piece comprising:

a support produced in a material which does not include plastic deformation and in which at least one hollow is provided, the hollow including side flanks made of the material which does not include plastic deformation, a first material within the hollow so that the side flanks are maintained in direct frictional contact with the first material to retain the first material, at least one setting hole formed within the first material, an aesthetic element positioned within the at least one setting hole and in direct contact with the first material, the at least one setting hole having a height that is greater than a height of the aesthetic element such that the aesthetic element is positioned entirely within the at least one setting hole, the first material being an at least partially amorphous alloy forming a substrate in which the at least one setting hole is provided, said substrate comprising in addition a catching mechanism that is made of the first material and that deforms in order to retain said aesthetic element in said at least one setting hole, and the catching mechanism being disposed at least at two opposing ends of the substrate that are in direct frictional contact with the side flanks of the hollow in the support.

2. The decorative piece according to claim 1, wherein the catching mechanism comprises at least one setting element.

3. The decorative piece according to claim 1, wherein said side flanks of the at least one hollow comprises vertical flanks in order to improve retention of the aesthetic element in the support.

4. The decorative piece according to claim 1, wherein said side flanks of the at least one hollow comprises flanks configured so that a surface of the hollow increases with a depth of the hollow.

5. The decorative piece according to claim 1, wherein said side flanks of the at least one hollow comprises flanks configured so that a surface of the hollow decreases with a depth of the hollow.

6. The decorative piece according to claim 1, wherein said at least one hollow comprises a retaining mechanism which extends from one of walls of the hollow in order to retain the first material in said hollow.

7. The decorative piece according to claim 6, wherein the retaining mechanism has a shape of at least one recess.

8. The decorative piece according to claim 6, wherein the retaining mechanism has a shape of at least one through-recess.

9. The decorative piece according to claim 6, wherein the retaining mechanism has a shape of at least one protuberance.

10. The decorative piece according to claim 1, wherein the first material is a totally amorphous metallic material.

11. The decorative piece according to claim 1, wherein a distance between the aesthetic element and one edge of the hollow is at least 0.01 mm.

12. The decorative piece according to claim 1, wherein the first material comprises at least one element which is of a precious type, included in a list comprising gold, platinum, palladium, rhenium, ruthenium, rhodium, silver, iridium or osmium.

13. The decorative piece according to claim 1, wherein the support is produced in a ceramic material.

14. The decorative piece according to claim 1, wherein the support is produced in a sapphire material.

15. The decorative piece according to claim 1, wherein the support is produced in a silicon material.

16. The decorative piece according to claim 1, wherein the support is produced in a glass material.

17. The decorative piece according to claim 1, wherein the first material includes an elastic limit less than 1,500 MPa.

18. The decorative piece according to claim 1, wherein the first material includes an elastic limit greater than 1,500 MPa.

19. The decorative piece according to claim 1, wherein the aesthetic element is positioned within the first material such that a top of the aesthetic element is recessed below a top of the first material and a bottom of the aesthetic element is spaced apart from the first material.

20. A setting method for the decorative piece according to claim 1, comprising:

a) providing the support provided with the at least one hollow;

b) providing the aesthetic element;

c) filling said hollow with the first material that is at least partially amorphous;

d) producing the at least one housing and the catching mechanism; and e) setting said aesthetic element by placing it in said at least one hollow and by deforming the catching mechanism so as to retain it.

21. The setting method according to claim 20, wherein the setting includes a plastic deformation of the catching mechanism.

22. The setting method according to claim 20, wherein the setting includes an elastic deformation of the catching mechanism.

23. The setting method according to claim 20, wherein the setting includes thermal expansion of the support and of the first material in order to set said aesthetic element in said at least one hollow.

24. The setting method according to claim 20, wherein the filling, the producing, and the setting are simultaneous, and the method further comprises placing said aesthetic element in the hollow and then filling said hollow with said first material.

25. The setting method according to claim 20, wherein the first material is a totally amorphous metallic material.

26. The setting method according to claim 20, wherein the first material comprises at least one element which is of a precious type, included in a list comprising gold, platinum, palladium, rhenium, ruthenium, rhodium, silver, iridium or osmium.

27. The setting method according to claim 20, wherein the filling the hollow takes place by casting.

28. The setting method according to claim 20, wherein the filling the hollow takes place by hot forming.

29. The setting method according to claim 20, wherein the filling the hollow takes place by powder sintering.

30. The setting method according to claim 20, wherein the filling includes filling the hollow by driving in.

31. The setting method according to claim 20, wherein the method further comprises crystallizing the first material.

32. The setting method according to claim 20, wherein the catching mechanism comprises at least one setting element.

33. The setting method according to claim 20, wherein said aesthetic element comprises at least one throat into which said first material is inserted in order to improve the retention of said aesthetic element.

* * * * *